US005133172A

United States Patent [19]

Soubrier

[11] Patent Number: 5,133,172

[45] Date of Patent: Jul. 28, 1992

[54] VERTICAL DANCER WITH CONSTANT TORQUE

[75] Inventor: Pierre Soubrier, Villecresnes, France

[73] Assignee: Baxter International Inc., Deerfield, Ill.

[21] Appl. No.: 357,388

[22] Filed: May 26, 1989

[51] Int. Cl.[5] ..... B65B 9/08; B65B 41/10; B65B 41/16

[52] U.S. Cl. ..... 53/455; 53/562; 53/389.4; 226/118; 493/213

[58] Field of Search ..... 53/451, 551, 389, 552, 53/554, 562, 455, 389.4; 493/24, 29, 25, 213, 302, 439; 226/118, 119

[56] References Cited

U.S. PATENT DOCUMENTS

| | | | |
|---|---|---|---|
| 3,267,822 | 8/1966 | Harrison | 53/551 X |
| 3,331,185 | 7/1967 | MacKay et al. | 53/562 |
| 3,553,934 | 1/1971 | Johnson et al. | 53/562 |
| 3,557,525 | 1/1968 | Bauder | 53/551 |
| 4,262,474 | 4/1981 | Reuter et al. | 53/551 |
| 4,603,536 | 8/1986 | De La Poype | 53/451 X |
| 4,693,053 | 9/1987 | Ballestrazzi et al. | 53/389 |
| 4,710,157 | 12/1987 | Posey | 493/213 |
| 4,793,564 | 12/1988 | Hank et al. | 226/118 X |
| 4,846,386 | 7/1989 | Gresens et al. | 226/118 |
| 4,848,063 | 7/1989 | Niske | 53/551 X |

*Primary Examiner*—Horace M. Culver
*Attorney, Agent, or Firm*—Paul E. Schaafsma; Amy L. H. Rockwell; Paul C. Flattery

[57] ABSTRACT

A dancer assembly for feeding a web of film having ports extending therefrom to a former for folding the web of film. The apparatus includes a dancer having a roller located between two tracks that allow the roller to move vertically along the tracks. The web of film being fed around the roller and vertically upwards toward the former. A quarter turn member for changing the flow path of the film from a substantially horizontal flow path to a substantially vertical flow path. And a member for moving horizontally, as a unit, the dancer and quarter turn member while maintaining a fixed spacial orientation of the dancer and the quarter turn. A method of feeding a web of film to a former is also provided.

20 Claims, 2 Drawing Sheets

VERTICAL DANCER WITH CONSTANT TORQUE

BACKGROUND OF THE INVENTION

The present invention relates generally to dancers for assisting in the transportation of a web of material through an apparatus. More specifically, the present invention relates to a vertical dancer for a form, fill, seal packaging machine.

Form, fill, seal packaging machines are utilized to produce, from a web of flexible film, a flexible container for housing material to be dispensed. Form, fill, seal packaging machines are utilized to seal pharmaceuticals, dairy products, wine, food stuffs, cosmetics, nutritional products, and other products in flexible containers. A form, fill, seal packaging machine provides an apparatus for packaging these products in an expedient manner.

In one type of form, fill, seal packaging machine, a web of heat sealable film is fed from a roller to a former or mandrel that folds the film, for example, into a tubular shape. The film is folded longitudinally and heat sealed along abutting longitudinal edges. The film is then passed around a fill system that deposits the product to be packaged into the film. To create individual packages, the web of film must be sealed across its width. These "transverse seals" function as a seal that forms a pouch in the web of film for receiving the material to be packaged, and seal the filled end of a previously filled pouch. After the transverse seals are created, the web may then be severed to create an individual bag.

In some types of packaging arts, including, inter alia, pharmaceuticals, food products, nutritional products, and dairy products, it is desirable to create flexible containers that include means for accessing the containers (hereinafter "ports"). As used herein, the term "ports" includes, without limitation, valves, ports and closures, fitments, and other means for accessing the container. Ports provide a means for establishing fluid communication between the container and an outside environment. An example of a container having a port is the VIAFLEX flexible container for parenteral solutions manufactured by Baxter Healthcare Corporation of Deerfield, Ill.

As stated above, to fold the film, a former is utilized. The former provides means for folding, or aligning, opposite sides of a web of substantially flat film so that the film can be created into flexible containers. When creating flexible containers from a web of film in a form, fill, seal packaging machine, it is important that, among other things: 1) the port extends from a bottom end of the resultant flexible container; and 2) that the sides of the film that define the resultant container are properly aligned. To accomplish this, it is critical that the film when it is fed to the former is properly positioned.

In one type of packaging machine, the film is fed to the former from a series of rollers that include a dancer and a "quarter turn." In this packaging machine, the film is fed to a first roller around a vertical dancer, around a second and third roller to the quarter turn, and then to the former. The dancer affords the ability to have a film reserve and allows a constant flow of film even in a "stop and go" process, such as in a packaging machine. The quarter turn functions to modify the flow path of the film from a horizontal flow path to a vertical flow path.

However, a number of disadvantages are exhibited by this prior method. When a web of film, having a different width than a previously used web of film is utilized, for making different size flexible bags, the quarter turn and last roller must be moved horizontally to accommodate the different width of film. This is necessary to insure that the two edges of the film are substantially, if not exactly, vertical as they approach the former. If the edges of the film are not vertical, the web of film will not be properly aligned when it is sealed.

Although the above assembly allows the quarter turn and last roller to be moved to accommodate a different width of film, when the quarter turn and last roller are moved the amount of surface contact of the film on the dancer is thereby varied. In this regard, the dancer in this construction moves on a rotatable arm as the angle of the film is varied. This causes the torque on the film to change which can effect the precision and alignment of the film in the machine. This can cause irregular forming of the web of film or can cause the driving rollers, that pull the film through the packaging machine, to pull more or less than the exact bag length necessary to create the flexible containers. This results in the driving rollers not being properly indexed.

Because the web of film is pulled through the packaging machine with a force of approximately 1 g, it is desirable, if not necessary, that a constant torque be exerted by the dancer on the web of film. But, as the dancer, in this prior method, moves on the rotatable arm, the torque exerted by the dancer on the film is varied.

In certain packaging machines, ports are attached to the web of film prior to the forming of the web of film. If ports are attached to the web of film prior to the film being formed, additional considerations must be taken into account with respect to a roller assembly including a dancer. Due to the port, the dancer or rollers over which the film passes must now accommodate the port in such a way that they do not damage the web of film or port as the film, having the port, is fed thereover.

SUMMARY OF THE INVENTION

The present invention provides an improved dancer assembly and method for feeding a web of film to a former in a form, fill, seal packaging machine. The dancer assembly of the present invention provides an apparatus that allows the film to directly drive the dancer, and thereby the dancer to directly feed the film, vertically, to the former. Due to the structure of the apparatus, it can be modified to accommodate webs of film having different widths while still maintaining a constant torque on the web of film.

In an embodiment of the present invention, the apparatus provides a vertical dancer that is so constructed and arranged that the web of film is directly fed from the vertical dancer to the former. The vertical dancer, preferably exerts a constant torque on at least the portion of the web of film located between the dancer and former. The apparatus includes means located upstream, with respect to the flow of the film, from the vertical dancer for changing the flow path of the web of film from a horizontal flow path to a vertical flow path.

In an embodiment of the present invention, a dancer assembly for feeding a web of film in a vertical direction is provided. The dancer assembly includes a dancer, the web of film is fed around the dancer and then is fed in a substantially vertical direction to the former. The dancer exerts a substantially constant torque on at least the portion of the web of film located between the dancer and a position downstream of the film's vertical flow path. A quarter turn means is provided for modifying the web of film's flow path from a substantially horizontal flow path to a substantially vertical flow path. Means are provided for moving horizontally, as a unit, the dancer and quarter turn means, while maintaining a fixed, spacial orientation of the dancer and quarter turn means.

In an embodiment, the dancer assembly includes means for receiving at least a portion of a port extending from the web of film as the film is fed therearound.

In a preferred embodiment, the present invention provides a dancer assembly for feeding a web of film, having ports extending therefrom, to a former for folding the web of film. The dancer assembly comprises a roller, located between two tracks, the tracks allowing the roller to move vertically along the tracks, the web of film being fed around the roller and vertically upwards towards the former. A quarter turn member is provided for changing the flow path of the web of film from a substantially horizontal flow path to a substantially vertical flow path. The quarter turn member is located upstream, with respect to the flow of the web of film, from the roller. Frame means are provided for securing the tracks and quarter turn member in a fixed spacial orientation with respect to each other. Means are provided for moving the frame means and thereby the quarter turn member, roller, and track horizontally a predetermined distance.

In an embodiment, the roller includes a slot for receiving at least a portion of a port extending from the web of film when the web of film is fed therearound.

In an embodiment, the means for moving the frame means includes a piston, means for activating the piston, and means for preventing movement of the frame means after the frame means has moved the predetermined distance.

In an embodiment, the weight of the roller is chosen so as to exert a constant torque on at least the portion of the web of film located between the roller and the former.

In an embodiment, the frame means includes a carriage coupled to at least one fixed horizontal member that allows the carriage horizontal movement thereon.

In an embodiment, at least one sensor is provided for determining when the frame means has moved a predetermined distance.

The present invention also provides a method for feeding a web of film in a packaging machine, to a former for folding the web of film comprising the steps of: feeding the film along a substantially horizontal path: providing means for altering the flow path of the web of film from a substantially horizontal path to a substantially vertical path; feeding the film around a vertical dancer, that includes a roller that can move in a vertical direction; and feeding the film directly from the vertical dancer in a substantially vertical direction to the former.

In an embodiment, the method includes the step of maintaining with the vertical dancer, a substantially constant torque on at least a portion of the web of film located between the vertical dancer and the former.

In another embodiment, the method includes the step of moving the vertical dancer and means for altering the flow path of the film, as a unit, horizontally a predetermined distance.

It is therefore an advantage of the present invention to provide an improved dancer for a form, fill, seal packaging machine.

It is a further advantage of the present invention to provide an improved method for feeding a web of film to a former in a form, fill, seal packaging machine.

Still further, an advantage of the present invention is that it provides a vertical dancer that affords a constant torque on at least a portion of the web of material being fed through a packaging machine.

Furthermore, an advantage of the present invention is that it provides a vertical dancer that can be utilized with a web of film having ports extending therefrom.

Another advantage of the present invention is that it provides a vertical dancer arrangement having a simplified construction with fewer parts than prior vertical dancer structures utilized in form, fill, seal packaging machines.

Still, an advantage of the present invention is that it provides a vertical dancer that simplifies the film flow path.

Moreover, an advantage of the present invention is that it provides a vertical dancer construction that reduces the number of rollers in contact with the web of film, reducing the surface contact of the film and the possibility of contamination of the film.

Further, an advantage of the present invention is that it provides a vertical dancer affording a constant torque because less friction is exerted due to the dancer construction.

Another advantage of the present invention is that it provides a dancer structure that provides constant torque even when adjusted for different film widths.

Additionally, an advantage of the present invention is that it provides a vertical dancer that can be adjusted to accommodate different film widths.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides a vertical dancer assembly that allows a web of material to be fed through a packaging machine, compensating for interruptions in the flow of film due to sealing and other steps in the process for creating from a web of film flexible containers. The dancer assembly, in the preferred embodiment of the invention set forth herein, is used in a form, fill, seal packaging machine to feed a web of film to a former wherein the film is folded into a tubular shape.

As used herein, the term "form, fill, seal packaging machine" refers to a machine for creating from a web of flexible film a container for housing a product. Briefly, in a typical form, fill, seal packaging machine, a web of film is pulled through a packaging machine wherein it is folded, sealed to itself, and filled with a product. Of course, the vertical dancer assembly of the present invention can be used in other packaging machines wherein a proper alignment of the web of material being fed therethrough is important.

Figure 1:
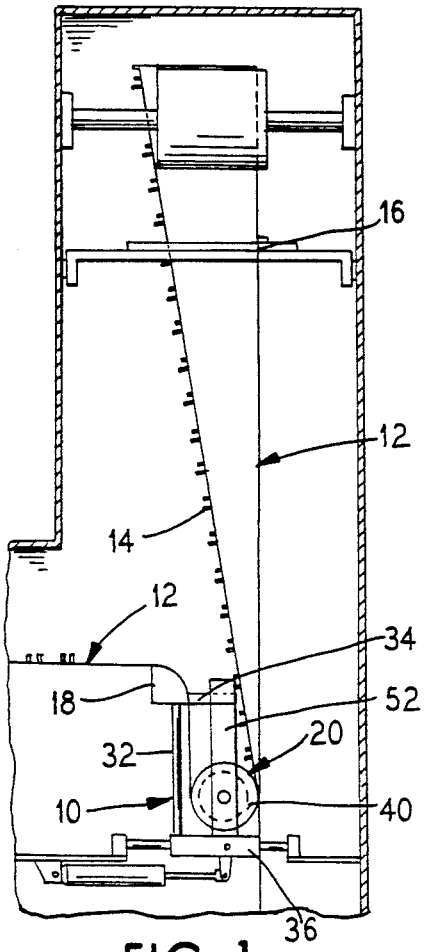
FIG. 1 illustrates a side perspective view of an embodiment of the vertical dancer assembly of the present invention.

Referring to FIG. 1, an embodiment of the dancer assembly 10 of the present invention is illustrated. As illustrated, a web of film 12, having ports 14 extending therefrom, is fed around the dancer assembly 10 to a former 16 where it is folded. The former 16 can be any former known in the art. An example of a former is disclosed in U.S. Pat. No. 4,603,536. The dancer assembly 10 has been found to function satisfactorily with a former such as that disclosed in U.S. Ser. No. 155,925, filed May 20, 1987, the disclosure of which is incorporated herein by reference.

The dancer assembly 10 of the present invention includes a quarter turn structure 18 and a vertical dancer structure 20. The quarter turn structure 18 functions to modify the flow path of the web of film 12 from a horizontal flow path downwardly, in a vertical direction, to the dancer structure 20 which, in turn, then directs the web of film 12 upwardly, on a vertical path, to the former 16.

Figure 3:
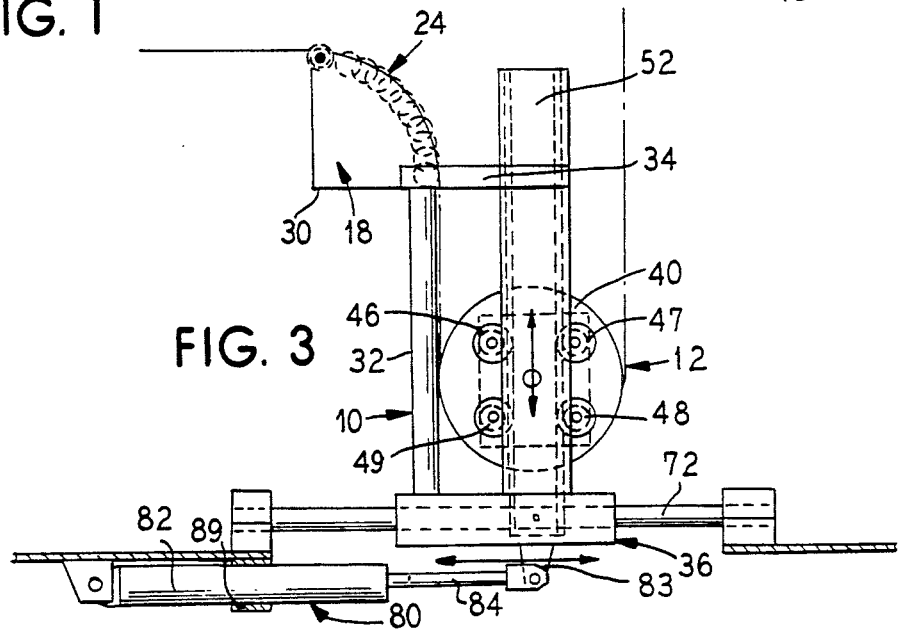
FIG. 3 illustrates a more detailed side elevational view of the apparatus illustrated in FIG. 1.
Figure 4:
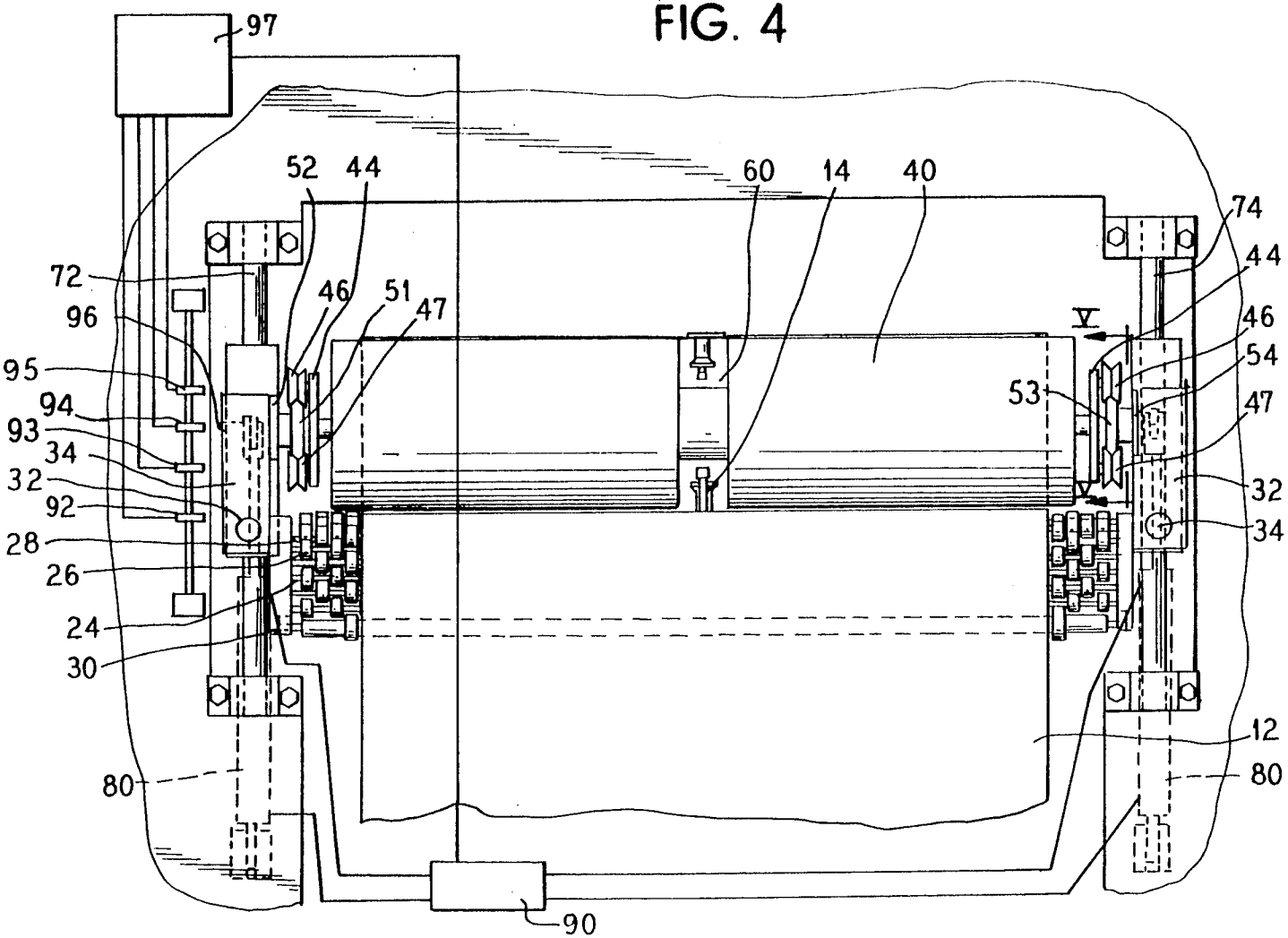
FIG. 4 illustrates a top elevational view of the apparatus illustrated in FIG. 1.

As illustrated in FIGS. 3 and 4, the quarter turn structure 18, in the embodiment of the present invention illustrated, includes a plurality of roller units 24. The roller units 24 each include a number of rollers 26 that are rotatably mounted on rods 28. The rollers 26 function to allow the web of film 12 to be fed over the quarter turn structure 18 while the structure imparts little to no drag. This allows the quarter turn structure 18 to modify the flow path of the web of film 12 from a horizontal direction to a vertical direction. Of course, if desired, the quarter turn structure 18 can be a roller or other structure rather than a plurality of rollers 26 mounted on a number of rods 28.

The roller units 24 are coupled to a roller frame 30. Although the roller frame 30, in the embodiment illustrated, has a pie-shaped construction, it should be appreciated that the roller frame 30 can have, if desired, a different construction. The roller frame 30 is coupled to vertical and horizontal frame structures 32 and 34, respectively. The vertical frame structure 32 includes a pair of rods each of which is coupled at a second end 35 thereof to a carriage 36. As discussed in detail below, the carriage 36 allows the dancer assembly 10 to move, as a unit, horizontally.

Figure 5:
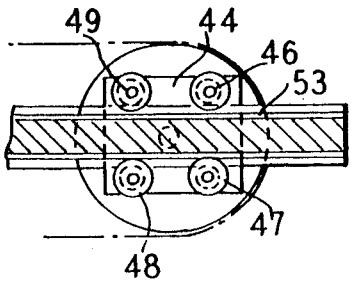
FIG. 5 illustrates a cross-sectional view of the apparatus of the present invention taken along lines VV of FIG. 4.

The dancer assembly 10, and specifically the dancer structure 20, includes a roller 40 around which the web of film 12 is fed. The roller 40 is mounted for vertical travel toward and away from the former 16. To this end, as illustrated in FIGS. 3-5, the roller 40 is rotatably mounted at each of its ends 41 and 42 to a plate 44 including four wheels 46, 47, 48, and 49. The wheels 46, 47, 48, and 49 have a V-shaped groove 50 allowing the wheels to receive a portion of tracks 51 and 53 that extend from frames 52 and 54, respectively. This allows the roller 40 to be located between the tracks 51 and 53, and thereby mounted between the frames 52 and 54. The roller 40 and tracks 51 and 53 are so constructed and arranged that they allow the roller 40 vertical movement up and down along the tracks. The force of gravity urges the roller 40 downwardly along the tracks 51 and 53 while the force exerted by the means for pulling the web of film 12 through the packaging machine pulls the roller 40 upwardly along the tracks.

Figure 2:
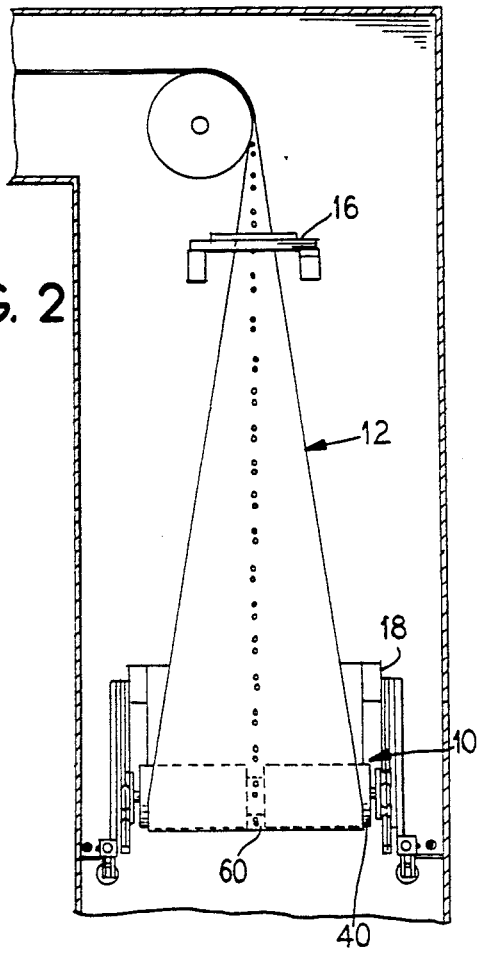
FIG. 2 illustrates a front elevational view of the apparatus illustrated in FIG. 1.

As illustrated in FIGS. 2 and 4, the roller 40 includes a slot 60 having a sufficient depth to receive at least a portion of a port 14 extending from the web of film 12. The slot 60 allows the film 12, having ports 14 extending therefrom, to be fed around the roller 40 without damaging the film or ports.

Preferably, the roller 40 is a metal roller constructed from 216 stainless steel or some other material that will not contaminate or damage the film. The roller 40 can be, for example, solid or a hollow cage-type roller. A solid metal roller 40 having a diameter of approximately six inches has been found to function satisfactorily.

Because, as previously stated, the roller 40 is mounted between the frames 52 and 54, to tracks 51 and 53, for vertical movement toward and away from the former 16, it can exert a constant torque on at least the portion of the web of film 12 located between the roller 40 and former 16. To this end, gravity causes the roller 40 to be urged downwardly while the force applied to pull the web of film 12 through the packaging machine urges the roller 40 towards the former 16. The weight of the roller 40 is chosen so that the force of gravity, exerted on the roller 40, creates a constant torque on the web of film. However, because the roller 40 can move toward the former 16, slack in the web of film during the process of feeding the web of film 12 through the packaging machine can be taken up and an uninterrupted flow of film through the packaging machine is achieved. The roller 40, in the embodiment illustrated, preferably has a vertical movement along the tracks 51 and 53 equal to approximately two bag lengths.

Referring now to FIG. 3, the dancer assembly 10 of the present invention is constructed so that it can be easily adjusted to accommodate different widths of film. To this end, the frame 52 and 54, including tracks 51 and 53, and the vertical frame structures 32 secured to the quarter turn 18 are coupled to a carriage 36 (as illustrated, each of the horizontal frame structures 34 secured to one end to the roller frame 30 is secured at a second to the frames 52 and 54). The carriage 36 is mounted on two guide rods 72 and 74 in such a manner that the carriage can move horizontally on the guide rods. By moving the carriage 36, both the dancer structure 20 and quarter turn 18, and thereby the total dancer assembly 10, are adjusted horizontally.

To adjust the dancer structure 20 to accommodate a different film width, the carriage 36 is moved horizontally along the guide rods 72 and 74. Although this horizontal movement modifies the position of the film 12 exiting the roller 40 with respect to the former 16. The fixed spacial relationship between the quarter turn 18 and dancer structure 20 is not affected by this movement and its relationship remains the same. But, even though the dancer structure 20 and quarter turn 18 are moved, the edges of the web of film 12 leaving the dancer assembly 10 remains approximately vertical.

The ability to move the dancer assembly 10, as a unit, results in a constant torque being exerted by the roller 40; because the film friction and the angle of the film with respect to the roller 40 and a vertical axis does not change. The angle of the film and vertical is important because the weight of the film creates a moment arm that varies as the angle between the film and the dancer varies. When the angle of the film with regard to the dancer and vertical changes, the moment arm on the dancer changes, changing the tension of the film. Because the position of the web of film 12 with respect to the dancer structure 20 does not change, the weight of the roller 40 produces a constant torque.

As illustrated, to move the carriage 36, a piston 80 is provided. The piston 80 includes a cylinder 82 and piston rod 84. The piston rod 84 is coupled at its end to a flange 83 extending from the carriage 36. Therefore, as the piston rod 84 moves so does the carriage 36 along guide rods 72 and 74.

Referring to FIG. 4, the piston 80 is actuated by fluid control means 90. Accordingly, when a different width of film is to be used, the fluid control means 90 is actuated to cause the piston 80, and, more specifically, the piston rod 84, to move. The fluid control means 90 is actuated by control means 97. Accordingly, to move the carriage 36, the control means 97 is actuated that in turn actuates the fluid control means 90.

Sensors 92, 93, 94, and 95 are provided for sensing movement of the carriage 36 to determine when the carriage has moved a predetermined distance. The sensors 92, 93, 94, and 95 are arranged to correspond to different container sizes (e.g., 100 ml, 500 ml) that will correspond to different film widths. The sensors 92, 93, 94, and 95 sense a member 96 that is located on the carriage 36; for example, member 96 can generate a magnetic field that is sensed by the sensors. When the sensed member 96 is aligned with an appropriate sensor 92, 93, 94, or 95 the sensor actuates the control means 97 that now functions to arrest movement of the piston 80, and specifically, the piston rod 84. This provides an accurate means for properly positioning the carriage 36, and thereby aligning the dancer assembly 10 so that the film is properly aligned as it is fed to the former 16.

To arrest movement of the piston 80, a brake 89 is provided. The brake 89 insures that the piston 80, and specifically the piston rod 84, does not move even if a compressible fluid is used in the piston cylinder 82.

As illustrated, the present invention provides a method wherein the web of film 12 after it exits the dancer assembly 10, i.e., the roller 40, is fed directly to the former 16. Likewise, the present invention provides a method that allows the dancer assembly 10, as a unit, to be adjusted to accommodate a variety of film widths to insure that the film moves vertically upwardly towards the former 16.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A packaging machine including a former for folding a web of film comprising:

a vertical dancer, the vertical dancer being so constructed and arranged that the web of film is fed directly, without an intervening roller, from the vertical dancer to the former.

2. The packaging machine of claim 1 wherein the vertical dancer exerts a constant torque on, at least, a portion of the web of film located between the dancer and former.

3. The packaging machine of claim 1 including means, located upstream with respect to the flow of film, from the vertical dancer, for changing the flow path of the web of film from the horizontal flow path to a vertical flow path.

4. The packaging machine of claim 1 wherein the vertical dancer includes means for receiving at least a portion of a port extending from the web of film

5. The packaging machine of claim 1 including means for moving the vertical dancer horizontally.

6. A dancer assembly for a web of film that is fed in a vertical direction comprising:

a dancer, the web of film being fed around the dancer and then being fed in a substantially vertical direction directly to a former for folding the web of film, the dancer exerting a substantially constant torque on at least a portion of the web of film located between the dancer and a position downstream of the film's vertical flow path;

a quarter turn means, for modifying the web of film's flow path from a substantially horizontal flow path to a substantially vertical flow path, the quarter turn means being located upstream with respect to the flow of the film from the dancer; and means for moving horizontally, as a unit, the dancer and quarter turn means, while maintaining a fixed special orientation of the dancer and quarter turn means.

7. The dancer assembly of claim 6 wherein the dancer includes means for receiving at least a portion of a port extending from the web of film as the film is fed therearound.

8. The dancer assembly of claim 7 wherein the dancer includes a roller, the web of film being fed around the roller, and the means for receiving at least a portion of a port includes a slot within the roller.

9. The dancer assembly of claim 6 wherein the dancer comprises a roller located between two frames, the web of film being fed around the roller, the roller and the two frames cooperating to allow the roller to move vertically between the frames.

10. The dancer assembly of claim 6 wherein the means for moving includes a piston.

11. A dancer assembly for feeding a web of film, having ports extending therefrom directly to a former for folding the web of film comprising:

a roller, located between two tracks that allow the roller to move vertically along the tracks, the web of film being fed around the roller and vertically upwards to the former without the web of film passing over an intervening roller between the roller and the former;

a quarter turn member for changing the flow path of the web of film from a substantially horizontal flow path to a substantially vertical flow path, the quarter turn member being located upstream, with respect to the flow of the web of film, from the roller;

frame means for securing the tracks and quarter turn member in a fixed special orientation with respect to each other; and means for moving the frame means, and thereby the quarter turn means, roller, and track horizontally a predetermined distance.

12. The dancer assembly of claim 11 wherein the roller includes a slot for receiving at least a portion of a port extending from the web of film when the web of film is fed therearound.

13. The dancer assembly of claim 11 wherein the means for moving the frame means includes a piston, means for activating the piston, and means for preventing movement of the frame means after the frame means has moved the predetermined distance.

14. The dancer assembly of claim 11 wherein the weight of the roller is chosen so as to exert a constant torque on at least a portion of the web of film located between the roller and the former.

15. The dancer assembly of claim 11 wherein the frame means includes a carriage coupled to at least one fixed horizontal member that allows the carriage horizontal movement thereon.

16. A method for feeding a web of film, in a packaging machine, to a former for folding the web of film comprising the steps of:

feeding the web of film along a substantially horizontal path;

providing means for altering the flow path of the web of film from a substantially horizontal path to a substantially vertical path;

feeding the film around a vertical dancer, including a roller than can move in a vertical direction; and feeding the film directly from the vertical dancer in a substantially vertical direction, to the former without passing the film over an intervening roller.

17. The method of claim 16 including the step of maintaining, with the vertical dancer, a substantially constant torque on at least a portion of the web of film located between the vertical dancer and former.

18. The method of claim 16 including the step of moving the vertical dancer and means for altering the flow path of the web of film, as a unit, horizontally a predetermined distance.

19. A dancer assembly for a web of film that is fed in a vertical direction comprising:

a dancer, the web of film being fed around the dancer and then being fed in a substantially vertical direction, the dancer exerting a substantially constant torque on at least a portion of the web of film located between the dancer and a position downstream of the film's vertical flow path;

a quarter turn means, for modifying the web of film's flow path from a substantially horizontal flow path to a substantially vertical flow path, the quarter turn means being located upstream with respect to the flow of the film from the dancer;

means for moving horizontally, as a unit, the dancer and quarter turn means, while maintaining a fixed spacial orientation of the dancer and quarter turn means; and means for actuating the means for moving and sensors for deactivating the means for moving after the dancer and quarter turn means have moved a predetermined distance.

20. A dancer assembly for feeding a web of film, having ports extending therefrom, to a former for folding the web of film comprising:

a roller, located between two tracks that allow the roller to move vertically along the tracks, the web of film being fed around the roller and vertically upwards toward the former;

a quarter turn member for changing the flow path of the web of film from a substantially horizontal flow path to a substantially vertical flow path, the quarter turn means being located upstream, with respect to the flow of the web of film, from the roller;

frame means for securing the tracks and quarter turn member in a fixed spacial orientation with respect to each other;

means for moving the frame means, and thereby the quarter turn means, roller, and track horizontally a predetermined distance; and at least one sensor for determining when the frame means has moved a predetermined distance.

* * * * *

UNITED STATES PATENT AND TRADEMARK OFFICE

CERTIFICATE OF CORRECTION

PATENT NO. : 5,133,172

DATED : July 28, 1992

INVENTOR(S) : Pierre Soubrier

It is certified that error appears in the above-identified patent and that said Letters Patent is hereby corrected as shown below:

In column 8, line 25, delete "special" and insert --spacial-- therefor.

In column 8, line 57, delete "special" and insert --spacial-- therefor.

Signed and Sealed this

Seventeenth Day of August, 1993

Bruce Lehman

*Attest:*

BRUCE LEHMAN

*Attesting Officer*

*Commissioner of Patents and Trademarks*